United States Patent [19]

Ray et al.

[11] 4,402,745

[45] Sep. 6, 1983

[54] NEW IRON-ALUMINUM-COPPER ALLOYS WHICH CONTAIN BORON AND HAVE BEEN PROCESSED BY RAPID SOLIDIFICATION PROCESS AND METHOD

[75] Inventors: Ranjan Ray, Waltham; Viswanathan Panchanathan, Billerica; Bill C. Giessen, Cambridge, all of Mass.

[73] Assignee: Marko Materials, Inc., N. Billerica, Mass.

[21] Appl. No.: 257,912

[22] Filed: Apr. 27, 1981

[51] Int. Cl.[3] ..... B22F 1/00

[52] U.S. Cl. ..... 75/251; 75/0.5 BA; 75/123 B; 75/124; 75/125; 148/442; 420/582

[58] Field of Search ..... 75/123 B, 124 F, 134 C, 75/134 F, 125, 251, 0.5 AA, 0.5 BA; 428/606; 148/442; 420/582

[56] References Cited

U.S. PATENT DOCUMENTS

| | | | |
|---|---|---|---|
| Re. 29,989 | 5/1979 | Polk et al. | 75/134 F |
| Re. 30,106 | 10/1979 | Polk et al. | 75/134 F |
| 1,493,191 | 5/1924 | De Golyer | 75/123 B |
| 4,052,201 | 10/1977 | Polk et al. | 75/134 F |
| 4,197,146 | 4/1980 | Frischmann | 75/251 |
| 4,236,946 | 12/1980 | Aboaf et al. | 75/123 B |
| 4,264,358 | 4/1981 | Johnson et al. | 75/134 V |
| 4,297,135 | 10/1981 | Giessen et al. | 75/170 |

OTHER PUBLICATIONS

Metallic Glasses, American Society for Metals 1978 p. 31.

Proc. Int. Conf. on Rapid Solidification Processing; Reston, Virginia 1980, Pub. Claitors Publishing Div., Baton Rouge, La.

Rapidly Quenched Metals, 3rd Int. Conf. vols. 1 and 2, The Metals Society, London 1978.

*Primary Examiner*—John P. Sheehan

*Attorney, Agent, or Firm*—Morse, Altman & Dacey

[57] ABSTRACT

New iron rich metal alloys containing aluminum and copper along with specific amounts of boron are disclosed. The alloys are subjected to rapid solidification processing (RSP) technique which produces cooling rates between $\sim 10^5$ to $10^7$ °C./sec. The as-quenched ribbon, powder etc. consists primarily of a metastable crystalline solid solution phase. The metastable crystalline phases are subjected to suitable heat treatments so as to produce a transformation to a stable multiphase microstructure which includes borides; this heat treated alloy exhibits superior mechanical properties with good corrosion and/or oxidation resistance for numerous engineering applications.

8 Claims, No Drawings

NEW IRON-ALUMINUM-COPPER ALLOYS WHICH CONTAIN BORON AND HAVE BEEN PROCESSED BY RAPID SOLIDIFICATION PROCESS AND METHOD

BACKGROUND OF THE INVENTION

1. Field of the Invention

This invention relates generally to rapidly solidified iron-aluminum-copper alloys obtained by adding small amounts of boron. This invention also relates to the preparation of these materials in the form of rapidly solidified powder and consolidation of these powders (or, alternatively, the rapidly solidified ribbon-like material) into bulk parts which are suitably heat treated to have desirable properties. This invention also relates to the preferred iron rich metal alloy compositions made by this method.

2. Description of the Prior Art

Rapid solidification processing (RSP) techniques offer outstanding prospects of new cost effective engineering materials with superior porperties [see Proc. Int. Conf. on Rapid Solidification Processing; Reston, VA, 1980; Published by Claitors Publishing Division, Baton Rouge, LA]. Metallic glasses, microcrystalline alloys, supersaturated solid solutions and ultrafine grained alloys with highly refined microstructures, in each case, often having complete chemical homogeneity are some of the products that can be made by utilizing RSP. [See Rapidly Quenched Metals, 3rd Int. Conf. Vol. 1 and 2, Cantor Ed; The Metals Society, London, 1978].

Several techniques are well established in the state of art to economically fabricate rapidly solidified alloys (at cooling rates of $\sim 10^{5°}$ to $10^{7°}$ C./sec) as ribbons, filaments, wires, flakes or powders in large quantities. One well known example is melt spin chill casting whereby the metal is spread as a thin layer on a conductive metallic substrate moving at high speed to form rapidly solidified ribbon. [See Proc. Int. Conf. on Rapid Solidification Processing, Reston, VA, 1977].

The current technological interest in materials produced by RSP, especially when followed by consolidation into bulk parts, may be traced in part to the problems associated with micro and macro segregation and undesirable massive grain boundary eutetic phases that occur in highly alloyed materials during conventional slow cooling processes (i.e.) ingot or mold casting. RSP removes macrosegregation altogether and significantly reduces spacing over which microsegregation occurs, if it occurs at all.

The design of alloys made by conventional slow cooling process is largely influenced by the corresponding equilibrium phase diagrams which indicate the existence and coexistence of the phases present in thermodynamic equilibrium. Alloys prepared by such processes are in or at least near equilibrium. The advent of rapid quenching from the melt has enabled material scientists to stray further from the state of equilibrium and has greatly widened the range of new alloys with unique structures and properties available for technological applications.

Commercial iron base alloys containing chromium and/or nickel find extensive use in corrosion and oxidation resistant applications. There have been limited efforts as reported in the prior art involving use of rapid solidification processing techniques to synthesise new oxidation and corrosion resistant iron base alloys which do not contain chromium, an element with less abundant natural deposits. A need therefore exists to develop new chromium-free iron base alloys with superior mechanical, oxidation and corrosion resistant properties for numerous industrial applications.

SUMMARY OF THE INVENTION

This invention features a class of iron base alloys having excellent corrosion and oxidation resistance combined with high hardness and strength when the production of these alloys includes a rapid solidification process. These alloys can be described by the following composition; $Fe_aAl_bCu_cM_dSi_eB_f$-[A] wherein Fe, Al, Cu, Si and B respectively represent iron, aluminum, copper, silicon and boron.

M is one or more of the metals nickel (Ni) and molybdenum (Mo), a, b, c, d, e and f represent atom percent of Fe, Al, Cu, M, Si and B respectively and have the following values a=45-70, b=5-20, 0=10-25, d=0-20, e=0-5 and f=5-12 with the provisos that, (i) the sum of (b+c) may not exceed 40, (ii) the sum of (b+c+d) may not exceed 50, (iii) the molybdenum content may not exceed 10 atom percent, (iv) the maximum value of (e+f) is 15, and, (v) the sum of (a+b+c+d+e+f) is 100. Unless otherwise specified all compositions set forth herein are in atomic percent.

Rapid solidification processing (RSP) [i.e. processing in which the liquid alloy is subjected to cooling rates of the order of $10^{5°}$ to $10^{7°}$ C./sec] of such boron-containing alloys produced a metastable crystalline structure which is chemically homogeneous and can be heat treated and/or thermo mechanically processed so as to form a fine dispersion of borides and/or silicides which strengthen the alloy as well as other intermetallics. The heat treated and/or thermo mechanically processed material is harder and stronger than conventional alloys while exhibiting good corrosion and oxidation resistance. The inclusion of boron in the alloy has several advantages. It enhances the supercooling of the liquid which is achievable and makes easier the formation of a chemically homogeneous, metastable crystalline product when a RSP is used. The fine borides and/or silicides formed in the RSP alloy after heat treatment strengthen the metal and enhance microstructural stability and strength. The inclusion of boron makes it possible to obtain a good yield of uniform material by melt spinning which is an economical RSP. The as-quenched melt spun ribbons are brittle and can be readily ground to a powder, a form especially suitable for consolidation into a transformed (ductile) final product. The melt spin method includes any of the processes such as single roll chill block casting, double roll quenching, melt extraction, melt drag, etc. where a thin layer of liquid metal is brought in contact with a solid substrate.

DETAILED DESCRIPTION OF THE PREFERRED EMBODIMENTS

In accordance with the present invention iron base alloys containing aluminum and copper are further alloyed with 5-20% of boron. These alloys are optionally alloyed with one or more of the following elements; 0-5% of Si, and 0-20% of Ni and Mo as single or combined with the provisos that the maximum content of Mo is 10%. The alloys may also contain limited amounts of other elements which are commercially found in iron base alloys without changing the essential behavior of the alloys. Typical examples include: $Fe_{70}Al_{10}Cu_{10}B_{10}$, $Fe_{60}Al_{15}Cu_{15}B_{10}$, $Fe_{65}Al_{10}Cu_{10}Ni_{10}B_5$, $Fe_{60}Al_{10}Cu_{15}Mo_{10}B_5$, and $Fe_{52}Al_{15}Cu_{15}Ni_5Mo_5Si_3B_5$.

The alloys of the present invention, upon rapid solidification processing from the melt by melt spin chill casting at cooling rates of the order of $10^{5°}$ to $10^{7°}$ C./sec, form brittle ribbons consisting predominantly of a solid solution phase with a high degree of compositional uniformity. The brittle ribbons are readily pulverised into a powder or staple configuration using standard comminution techniques. The powder or staple is consolidated into bulk parts using powder metallurgical techniques optionally followed by heat treatments for optimised properties. The bulk alloys contain finely dispersed intermetallic compounds and borides and/or silicides within the iron-rich matrix, such material being ductile and having high hardness and strength compared to known iron base alloys.

When the alloys within the scope of the present invention are solidified by conventional slow cooling processes they inherit highly segregated microstructures with large compositional non-uniformity and a large eutectic network of brittle boride phases and hence exhibit poor mechanical properties. In contrast, when the alloys are made using RSP techniques followed by heat treatment at high temperatures, preferably between 800° to 950° C. for 0.1 to 100 hrs., the precipitation of ultrafine complex metallic borides such as MB, $M_2B$; $M_6B$ etc. takes place where M is one or more of the metals in the alloys, these boride particles with average particle size of ~0.5 micron, preferably 0.05 micron, being finely dispersed both intergranularly and intragranularly.

Typically, the matrix grains have a size less than 10 microns, preferably less than 2 microns. The high temperature heat treatment necessary to generate the above described microstructures of the alloys of the present invention can be a separate annealing treatment or can occur along with the consolidation step. Consolidation can also be achieved by hot mechanical deformation at a high strain rate whereby finer boride particles will precipitate out in the matrix.

The fully heat treated RSP alloys of the present invention exhibit high strength combined with good ductility. The alloys of the present invention have hardness values of 285 to 600 Kg/mm$^2$. In comparison, the standard stainless and heat resisting steels have a maximum hardness of about 350 Kg/mm$^2$.

The invention discloses preparation of rapidly solidified powders of the present boron-containing iron-aluminum-copper alloys by melt spinning brittle ribbons followed by mechanical pulverisation of the ribbons. Other rapidly solidifed powder processing methods, such as forced convective cooling of atomised droplets, known in the art, can be used to make rapidly solidified powders of the present alloys and such powders can be subsequently powder metallurgically consolidated into bulk parts and/or heat treated for optimised microstructures, mechanical properties and corrosion and oxidation resistant characteristics.

The powders of the present alloys obtained from RSP, either made from the melt or the filaments, can be consolidated into bulk parts (i.e.) bars, rods, plates, discs etc. by various known metallurgical processing techniques such as hot extrusion, hot forging, hot isostatic pressing, hot rolling, cold pressing followed by sintering, etc.

While any of the wide variety of RSP techniques can be employed in the practice of this invention, the combination of melt spinning and subsequent pulverisation is preferred. The quench rate experienced by the melt is much more uniform in the melt spinning process than for e.g. atomization processes. In atomization, the quench rate and hence the metastable structure and the final heat treated structure derived therefrom varies greatly with particle size. Screening out the larger particles formed from atomization gives material which has been subjected to a more uniform quench. However, the yield is reduced making the process less economical. In contrast, powders made from pulverised ribbons experience the same quench history. The melt spinning procedure can be practiced with the present alloys so as to have a high yield (e.g. >95%) of relatively fine powder (e.g. −100 mesh). Alternatively, the rapidly solidified filaments as formed or after partial fragmentation can be consolidated directly into bulk parts without the step necessary to form an intermediate powder.

The boron content of the present alloys in the range of 5 to 12 atom percent is critical. When the boron content is less than 5 atom percent the iron base alloys are difficult to form as rapidly solidified brittle ribbons by the method of melt deposition on a rotating chill substrate (i.e. melt spinning). This is due to the inability of the boron-lean alloy melts to form a stable molten pool on the quench surface. Furthermore, at very low boron content the alloys have less desirable properties in the heat treated condition because of having insufficient amounts of the strengthening borides that can be formed by the heat treatment. Thus, more than 5 atom percent boron is desirable.

When the boron content is high (e.g. >12 atom percent), the heat treated alloys exhibit poor mechanical properties due to excessive amounts of hard and brittle boride particles in the microstructure. Thus, not more than 12 atom percent boron is desirable.

The rapidly solidified brittle ribbons made by melt spinning can be mechanically comminuted into powders having particle size less than 100 U.S. mesh using standard equipments such as hammer mill, ball mill, fluid energy mill and the like.

The physical properties of the heat treated alloys depend on alloy compositions and the heat treatment cycles employed. Thus, a specific property can be optimised by identifying those alloying elements and the degree of alloying which optimise that property. Of particular interest in these chromium-free iron base alloys are increased strength and hardness and improved oxidation and corrosion resistance.

The alloys of the system Fe-Al-Cu-B with boron contents 8 to 12% prepared in accordance with the present invention belong to a preferred group of alloys. These alloys are described by the formula $Fe_{50-70}Al_{10-20}Cu_{10-20}B_{8-12}$. Examples include $Fe_{60}Al_{15}Cu_{15}B_{10}$, $Fe_{70}Al_{10}Cu_{10}B_{10}$, $Fe_{55}Al_{20}Cu_{15}B_{10}$ and $Fe_{58}Al_{17}Cu_{13}B_{12}$. The above alloys upon rapid quenching by melt spinning form extremely brittle ribbons consisting of single solid solution phase. The quenched alloys may additionally contain borides dispersed in the matrix. Upon heat treatment between 800° and 950° C. for 1 to 3 hrs., precipitation of ultrafine complex borides takes place both intragranularly and intergranularly. After such heat treatment the above described Fe-Al-Cu-B alloys become ductile and possess hardness value between 450 to 570 Kg/mm$^2$.

Another preferred class of alloys is based on the addition of nickel and/or silicon to Fe-Al-Cu-B alloy. This class is defined by the general formula $Fe_{50-70}Al_{5-15}Cu_{10-20}Ni_{5-15}Si_{0-5}B_{5-12}$ with the provisos that the maximum contents of (B+Si) is 15 at %. Examples include $Fe_{55}Al_{15}Cu_{10}Ni_8Si_2B_{10}$, $Fe_{60}Al_{10}Cu_{15}Ni_5B_{10}$, $Fe_{70}Al_5Cu_{12}Ni_5B_8$, $Fe_{60}Al_{15}Cu_{10}Ni_5B_{10}$and $Fe_{60}Al_{10}Cu_{10}Ni_5Si_5B_{10}$.

The ribbons obtained by melt spinning are brittle which, upon heat treatment above 800° C. become ductile and hard with typical hardness values ranging between 285 to 600 Kg/mm$^2$.

Another preferred class of alloys is based on the addition of molybdenum and/or silicon to Fe-Al-Cu-Ni-B alloy. This class is defined by the general formula $Fe_{50-65}Al_{10-20}Cu_{10-20}$ $(Ni, Mo)_{5-15}Si_{0-5}B_{5-12}$, with the provisos that the maximum content of molybdenum is 10 atom percent and the maximum content of (B+Si) is 15 atom percent. Examples include $Fe_{55}Al_{10}Cu_{15}Ni_5B_{10}$, $Fe_{70}Al_5Cu_{12}Ni_5B_8$, $Fe_{60}Al_{15}Cu_{10}Ni_5B_{10}$ and $Fe_{60}Al_{10}Cu_{10}Ni_5Mo_5Si_5B_{10}$, $Fe_{50}Al_{15}Cu_{10}Ni_8Mo_7B_{10}$, $Fe_{50}Al_{15}Cu_{10}Ni_5Mo_8Si_2B_{10}$ and $Fe_{60}Al_5Cu_{15}Ni_5Si_2B_8$.

The ribbons obtained by melt spinning are brittle which upon heat treatment above 800° C. become ductile and hard with typical hardness values ranging between 400 to 600 Kg/mm$^2$.

For the above alloys the dominant mechanism of strengthening is dispersion hardening. To achieve the most effective dispersion hardening the boride particles must be very small and the distribution of the particles must be uniform.

All the above alloys described within the preferred classes exhibit good atmospheric corrosion when exposed in an indoor as well as an outdoor environment and also in salt water. They also have good oxidation resistance.

EXAMPLES 1 to 3

Selected Fe-Al-Cu alloys were alloyed with boron contents ranging from 10 to 12%. The boron-containing alloys were melt spun into ribbons having thicknesses of 25 to 75 microns thick by the RSP technique of melt spinning using a rotating Cu-Be cylinder having a quench surface speed of ~5000 ft/min. The ribbons were found by X-ray diffraction analysis to consist predominantly of a single solid solution phase. Ductility of the ribbons were measured by the bend test. The ribbon was bent to form a loop and the diameter of the loop was gradually reduced until the loop fractured. The breaking diameter of the loop is a measure of ductility. The larger the breaking diameter for a given ribbon thickness, the more brittle the ribbon is considered to be (i.e.) the less ductile. The as-quenched ribbons were all found to have breaking diameters of ~0.1 inch and thus are quite brittle. The ribbons were heat treated at 800° to 950° C. for 2 hrs. and then air cooled to room temperature. The ribbons were found to be ductile. A ribbon which bends back onto inself without breaking has deformed plastically into a 'V' shape and is labelled ductile. The hardness values of these ribbons ranged between 450 to 570 Kg/mm$^2$.

TABLE 1

| Example | Alloy composition [atom percent] | Heat Treatment (800° C. for 2 hrs.) Hardness of the ribbon Kg/mm$^2$ | Ductile to 180° Bending |
|---|---|---|---|
| 1 | $Fe_{65}Al_{10}Cu_{15}B_{10}$ | 550 | yes |
| 2 | $Fe_{58}Al_{15}Cu_{15}B_{12}$ | 570 | yes |
| 3 | $Fe_{55}Al_{15}Cu_{20}B_{10}$ | 480 | yes |

EXAMPLES 4 to 11

Several Fe-Al-Cu alloys containing nickel and/or silicon along with boron were prepared as RSP ribbons in 50 to 100 gms. quantity in accordance with the present invention. Some typical compositions are given in Table 2. The as-cast ribbons were found to be brittle to bending and were readily pulverised into powders under 100 mesh using a commercial rotating hammer mill. The as-quenched ribbons of the above alloys upon heat treatment above 800° C. for 2 hrs. were found to become ductile. The heat treated ribbons exhibited hardness values between 285 to 600 Kg/mm$^2$.

TABLE 2

| Example | Alloy Composition [atom percent] | Heat Treatment (800° for 2 hrs.) Hardness of the ribbon Kg/mm$^2$ | Ductile to 180° Bending |
|---|---|---|---|
| 4 | $Fe_{55}Al_5Cu_{20}Ni_{10}B_{10}$ | 342 | yes |
| 5 | $Fe_{55}Al_8Cu_{15}Ni_{10}B_{12}$ | 600 | yes |
| 6 | $Fe_{50}Al_8Cu_{20}Ni_{10}B_{12}$ | 465 | yes |
| 7 | $Fe_{55}Al_{10}Cu_{15}Ni_{10}Si_5B_5$ | 473 | yes |
| 8 | $Fe_{55}Al_{10}Cu_{20}N_5Si_5B_5$ | 450 | yes |
| 9 | $Fe_{51}Al_{12}Cu_{15}Ni_{10}Si_2B_{10}$ | 520 | yes |
| 10 | $Fe_{49}Al_{10}Cu_{15}Ni_{15}Si_3B_8$ | 285 | yes |
| 11 | $Fe_{50}Al_{10}Cu_{15}Ni_{15}B_{10}$ | 420 | yes |

EXAMPLES 12 to 14

Several Fe-Al-Cu alloys containing nickel, molybdenum and/or silicon along with boron were prepared as RSP Ribbons in 50–100 gms. quantity in accordance with the present invention. Some typical compositions are given in Table 3. The as-cast ribbons were found to be brittle to bending and were readily pulverised into powders under 100 mesh using a commercial hammer mill. The as-quenched ribbons of the above alloys upon heat treatment above 850° C. for 2 hrs. were found to become ductile. The heat treated ribbons exhibited hardness values between 400 to 600 Kg/mm$^2$.

TABLE 3

| Example | Alloy composition [atom percent] | Heat treatment (850° for 2 hrs.) Hardness of the ribbon Kg/mm$^2$ | Ductile to 180° Bending |
|---|---|---|---|
| 12 | $Fe_{51}Al_{12}Cu_{12}Ni_8Mo_7Si_2B_8$ | 600 | yes |
| 13 | $Fe_{54}Al_{15}Cu_{15}Mo_4Si_3B_9$ | 450 | yes |
| 14 | $Fe_{57}Al_{15}Cu_{15}Ni_3Mo_2B_8$ | 400 | yes |

EXAMPLES 15 to 23

The following alloys (refer Table 4) were exposed in an indoor atmospheric environment for 1000 hrs. All the alloys were found to exhibit excellent resistance to indoor atmospheric corrosion (i.e.) the alloys showed no sign of discoloration or tarnish.

TABLE 4

| Example | Alloy Composition [atom percent] |
|---|---|
| 15 | $Fe_{65}Al_{10}Cu_{15}B_{10}$ |
| 16 | $Fe_{55}Al_{15}Cu_{20}B_{10}$ |
| 17 | $Fe_{55}Al_{5}Cu_{20}Ni_{10}B_{10}$ |
| 18 | $Fe_{50}Al_{8}Cu_{20}Ni_{10}B_{12}$ |
| 19 | $Fe_{55}Al_{10}Cu_{15}Ni_{10}Si_{5}B_{5}$ |
| 20 | $Fe_{51}Al_{12}Cu_{15}Ni_{10}Si_{2}B_{10}$ |
| 21 | $Fe_{49}Al_{10}Cu_{15}Ni_{15}Si_{3}B_{8}$ |
| 22 | $Fe_{50}Al_{10}Cu_{15}Ni_{15}B_{10}$ |
| 23 | $Fe_{51}Al_{12}Cu_{12}Ni_{8}Mo_{7}Si_{2}B_{8}$ |

EXAMPLES 24 to 32

Alloys given in Table 5 were exposed to an outdoor atmospheric environment for 1000 hours. The alloys were found to show excellent resistance to outdoor atmospheric corrosion (i.e.) the alloys showed no sign of discoloration or tarnish.

TABLE 5

| Example | Alloy Composition [atom percent] |
|---|---|
| 24 | $Fe_{65}Al_{10}Cu_{15}B_{10}$ |
| 25 | $Fe_{55}Al_{15}Cu_{20}B_{10}$ |
| 26 | $Fe_{55}Al_{5}Cu_{20}Ni_{10}B_{10}$ |
| 27 | $Fe_{50}Al_{8}Cu_{20}Ni_{10}B_{12}$ |
| 28 | $Fe_{55}Al_{10}Cu_{15}Ni_{10}Si_{5}B_{5}$ |
| 29 | $Fe_{51}Al_{12}Cu_{15}Ni_{10}Si_{2}B_{10}$ |
| 30 | $Fe_{49}Al_{10}Cu_{15}Ni_{16}Si_{3}B_{8}$ |
| 31 | $Fe_{50}Al_{10}Cu_{15}Ni_{15}B_{10}$ |
| 32 | $Fe_{51}Al_{12}Cu_{12}Ni_{8}Mo_{7}Si_{2}B_{8}$ |

EXAMPLES 33 to 38

The following alloys (Table 6) were exposed at a temperature of 750° C. for 2 hrs. The alloys did not show any trace of oxidation as evidenced by the lack of oxide scale formation.

TABLE 6

| Example | Alloy Composition [atom percent] |
|---|---|
| 33 | $Fe_{65}Al_{10}Cu_{15}B_{10}$ |
| 34 | $Fe_{55}Al_{15}Cu_{20}B_{10}$ |
| 35 | $Fe_{55}Al_{10}Cu_{15}Ni_{10}Si_{5}B_{5}$ |
| 36 | $Fe_{51}Al_{12}Cu_{15}Ni_{10}Si_{2}B_{10}$ |
| 37 | $Fe_{49}Al_{10}Cu_{15}Ni_{15}Si_{3}B_{8}$ |
| 38 | $Fe_{51}Al_{12}Cu_{12}Ni_{8}Mo_{7}Si_{2}B_{8}$ |

EXAMPLES 39 to 41

The following alloys (Table 7) were exposed at a temperature of 750° C. for 16 hrs. The alloys did not show any trace of oxidation as evidenced by the lack of oxide scale formation.

TABLE 7

| Example | Alloy Composition [atom percent] |
|---|---|
| 39 | $Fe_{65}Al_{10}Cu_{15}B_{10}$ |
| 40 | $Fe_{55}Al_{10}Cu_{15}Ni_{10}Si_{5}B_{5}$ |
| 41 | $Fe_{51}Al_{12}Cu_{12}Ni_{8}Mo_{7}Si_{2}B_{8}$ |

EXAMPLES 42 to 44

Alloys of composition given in Table 8 were kept in 5 wt % sodium chloride solution for 120 hrs. They did not show any corrosion as evidenced by the clear surface.

TABLE 8

| Example | Alloy Composition [atom percent] |
|---|---|
| 42 | $Fe_{51}Al_{12}Cu_{12}Ni_{8}Mo_{7}Si_{2}B_{8}$ |
| 43 | $Fe_{49}Al_{10}Cu_{15}Ni_{15}Si_{3}B_{8}$ |
| 44 | $Fe_{55}Al_{10}Cu_{15}Ni_{10}Si_{5}B_{5}$ |

EXAMPLE 45

The following example illustrates an economical method of continuous production RSP powder of the boron modified iron rich alloys of the composition indicated in (A) with the present invention.

The iron base alloys containing boron are melted in any of the standard melting furnaces. The melt is transferred via a ladle into a tundish having a series of orifices. A multiple number of jets are allowed to impinge on a rotating water cooled copper-beryllium drum whereby the melt is rapidly solidified as ribbons. The as-cast brittle ribbons were directly fed into a hammer mill of appropriate capacity wherein the ribbons are ground into powders of desirable size ranges.

Having thus described the invention, what we claim and desire to obtain by Letters Patent of the United States is:

1. A metastable crystalline solid solution alloy of the composition $Fe_a Al_b Cu_c M_d Si_e B_f$ wherein M is at least one element selected from the group consisting of nickel, molybdenum, wherein the subscripts represent atom percent having the following values; a=45–65, b=5–20, c=10–25, d=0–20, e=0–5, and f=5–12 with the provisos that the sum of b+c may not exceed 40, the sum of b+c+d may not exceed 50, the molybdenum content may not exceed 10, the sum of e+f may not exceed 15 and the sum of a+b+c+d+e+f is 100, wherein the said alloy is being prepared by the method comprising the steps:

a. forming a melt of said alloy b. depositing said melt against a rapidly moving quench surface adapted to quench said melt at a rate in the range approximately $10^{5°}$ to $10^{7°}$ C./sec and form thereby a rapidly solidified brittle strip and c. comminuting said strip into powders.

2. The alloy of claim 1 in the form of a body having a thickness of at least 0.1 mm measured in the shortest dimension.

3. The metastable crystalline solid solution alloy of claim 1 having the composition $Fe_{50-65}Al_{10-20}Cu_{10-20}B_{8-12}$ with the provisos the sum of atom percent of Fe, Al, Cu and B is 100, wherein the said alloy is being prepared by the method comprising the steps:

a. forming a melt of said alloy b. deposition said melt against a rapidly moving quench surface adapted to quench said melt at a rate in the range approximately $10^{5°}$ to $10^{7°}$ C./sec and form thereby a rapidly solidified brittle strip and c. comminuting said strip into powders.

4. The alloy of claim 3 in the form of a body having a thickness of at least 0.1 mm measured in the shortest dimension.

5. The metastable crystalline solid solution alloy of claim 1 having the composition $Fe_{50-65}Al_{5-15}Cu_{10-20}Ni_{5-15}Si_{0-5}B_{5-12}$ with the provisos that the sum of atom percent of Fe, Al, Cu, Ni, Si and B is 100 and the atom percent of B°Si may not exceed 15, wherein the said alloy is being prepared by the method comprising the steps:

a. forming a melt of said alloy b. depositing said melt against a rapidly moving quench surface adapted to quench said melt at a rate in the range approximately $10^{5°}$ to $10^{7°}$ C./sec and form thereby a rapidly solididfied brittle strip and c. comminuting said strip into powders.

6. The alloy of claim 5 in the form of a body having a thickness of at least 0.1 mm measured in the shortest dimension.

7. A metastable crystalline solid solution alloy of claim 1 having the composition $Fe_{50-65}Al_{10-20}Cu_{10-20}(Ni, Mo)_{5-15}Si_{0-5}B_{5-12}$ with the provisos that the sum of atom percent of Fe, Al, Cu, Ni, Mo, Si and B is 100 and the atom percent of B+Si may not exceed 15, wherein the said alloy is being prepared by the method comprising the steps:

a. forming a melt of said alloy b. depositing said melt against a rapidly moving quench surface adapted to quench said melt at a rate in the range approximately $10^{5°}$ to $10^{7°}$ C./sec and form thereby a rapidly solidified brittle strip and c. comminuting said strip into powders.

8. The alloy of claim 7 in the form of a body having a thickness of at least 0.1 mm measured in the shortest dimension.

* * * * *